US009247339B2

(12) United States Patent
Alexander

(10) Patent No.: US 9,247,339 B2
(45) Date of Patent: Jan. 26, 2016

(54) LOUDSPEAKER DESIGN

(71) Applicant: Eric Jay Alexander, Orem, UT (US)

(72) Inventor: Eric Jay Alexander, Orem, UT (US)

( * ) Notice: Subject to any disclaimer, the term of this patent is extended or adjusted under 35 U.S.C. 154(b) by 0 days.

(21) Appl. No.: 14/223,696

(22) Filed: Mar. 24, 2014

(65) Prior Publication Data

US 2014/0286510 A1 Sep. 25, 2014

Related U.S. Application Data

(60) Provisional application No. 61/804,622, filed on Mar. 22, 2013.

(51) Int. Cl.

| | |
|---|---|
| ***H04R 25/00*** | (2006.01) |
| ***H04R 1/26*** | (2006.01) |
| *H04R 1/40* | (2006.01) |
| *H04R 27/00* | (2006.01) |

(52) U.S. Cl.
CPC *H04R 1/26* (2013.01); *H04R 1/403* (2013.01); *H04R 27/00* (2013.01); *H04R 2201/401* (2013.01); *H04R 2201/403* (2013.01)

(58) Field of Classification Search
CPC ..... H04R 1/26; H04R 1/403; H04R 27/00; H04R 2201/401; H04R 2201/403
See application file for complete search history.

(56) References Cited

U.S. PATENT DOCUMENTS

| | | | | |
|---|---|---|---|---|
| 3,285,116 | A * | 11/1966 | Rhodes | 84/176 |
| 3,538,232 | A * | 11/1970 | Knauert et al. | 84/731 |
| 2011/0245585 | A1* | 10/2011 | Oxford | 600/26 |
| 2012/0006184 | A1* | 1/2012 | Giordano et al. | 84/724 |
| 2012/0063628 | A1* | 3/2012 | Rizzello | 381/355 |

OTHER PUBLICATIONS

J.B. Calvert, Microphones, web article accessed Aug. 5, 2015 and reportedly created Aug. 31, 2003 and last revised Dec. 3, 2009, available at http://mysite.du.edu/~jcalvert/tech/microph.htm.

* cited by examiner

*Primary Examiner* — Tuan D Nguyen
(74) *Attorney, Agent, or Firm* — Kirton McConkie; Adam D. Stevens

(57) ABSTRACT

Improved speakers are better able to accurately reproduce sound through the use of low-mass transducers.

19 Claims, 8 Drawing Sheets

LOUDSPEAKER DESIGN

CROSS-REFERENCE TO RELATED APPLICATIONS

This application claims the benefit of U.S. Provisional Application No. 61/804,622 which was filed on Mar. 22, 2013.

BACKGROUND OF THE INVENTION

1. Field of the Invention

The present invention relates to loudspeakers, and more particularly to designing loudspeakers to more faithfully and accurately reproduce signals.

2. Background and Related Art

It is common to play back recorded music through an audio system and/or reproduce the music of a live performance through microphone(s) and an amplified sound system to distribute sound to listener(s). The key elements of an audio system typically consist of a source (a recording or musician for example), an amplifier, and a loudspeaker.

BRIEF SUMMARY OF THE INVENTION

According to implementations of the invention, new and improved transducers (a woofer for example) are specifically designed to match or more closely match the mass of the musical instrument producing the music. For example: a woofer is designed to be highly compliant with very low moving mass and a low resonant frequency. Existing known obscure transducers that were never intended to be applied in speakers for this purpose work and have been used experimentally to prove the concept. New transducers may be designed to further extend and prove the concept. For example, current copper-clad aluminum windings of existing transducers could be replaced with copper-clad beryllium windings to significantly reduce the mass of a transducer.

According to additional implementations of the invention, a very low mass mid-range and high frequency type transducer is specifically dedicated to reproducing efficiently the overtone spectra contained in music. This is not to be confused with the common mid-range transducer produced today. This new device and method will likely be placed and positioned closely to the larger bass transducer (a woofer) and would accurately reproduce the musical overtones. One possible starting point for this new device is to have an efficient frequency range from approximately 100 Hz-2000-Hz and for this device to be attenuated approximately −10 dB. Most overtones in music are −10 dB below fundamental tone so a dovetailing type match can be made and improved sound would result.

According to additional implementations of the invention, one or more array(s) of very small transducers with minimal moving mass with or without separate amplification work in tandem grouped closely together to reproduce the lowest audible frequencies while keeping all related overtones completely intact. In one implementation a long column of small transducers quickly switches and/or cycles on and off with precision—even switching at speeds faster than that of the speed of sound consecutively so low frequencies can be continually reinforced over the length of the column and quickly be acoustically multiplied. High sound pressure levels and intensity are realized from the length of the column (low frequency wavelengths are long) and the overtones are left un-attenuated and intact.

This effect could be compared to frames-per-second in movies and videos. The moving frames provide the viewer with a flowing and precise image. The high speed switching of many multiple transducers will produce an acoustic effect comparable to that of many frames-per-second of video. An example illustrates the concept: lighting and its audible result called thunder in nature could be thought of as a very long column (a line source) of sound. Potential energy is high, the mass is low, and its speed of propagation is fast. The resultant acoustic event literally shakes windows and houses with great intensity. A scaled-down high-speed, low mass switching acoustical device roughly simulates the way thunder propagates from top to bottom through our atmosphere in nature. This type of device would have potential for very low frequencies to be realized using small transducers with great potential resulting intensity while keeping overtones and resultant waveforms intact. An alternative construction includes a circular array containing multiple transducers operating in the same fashion, as well as any other desired geometric array of multiple transducers.

According to additional implementations of the invention, multiple transducers are used to accurately reproduce the entire musical and audible spectrum in loudspeaker design. The crossover frequency (the transition from a low frequency transducer to a smaller and lower mass high frequency transducer) is implemented in a fashion that keeps the overtones accurately intact and that smoothly and uniformly transitions from a low frequency transducer to a high frequency transducer with commonly accepted low and high pass filtering techniques.

BRIEF DESCRIPTION OF THE SEVERAL VIEWS OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

Figure 1:
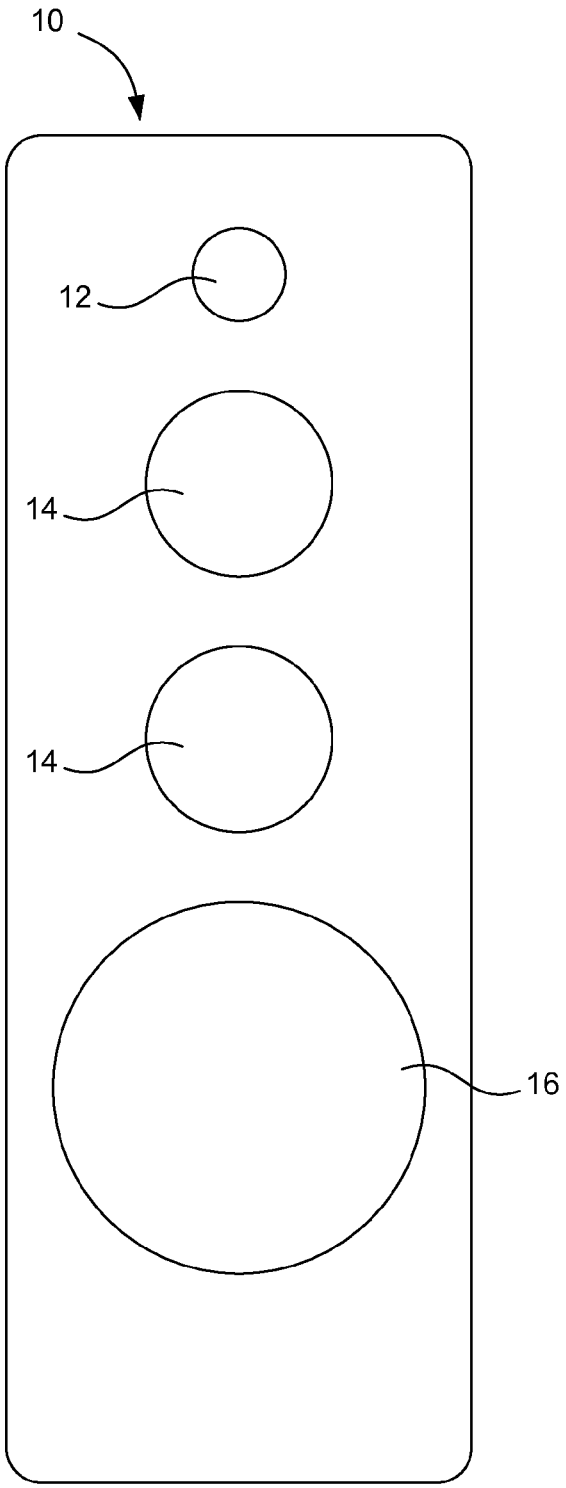
FIG. 1 shows a representative speaker.

A description of embodiments of the present invention will now be given with reference to the Figures. It is expected that the present invention may take many other forms and shapes, hence the following disclosure is intended to be illustrative and not limiting, and the scope of the invention should be determined by reference to the appended claims.

According to embodiments of the invention, new and improved transducers (a woofer for example) are specifically designed to match or more closely match the mass of the musical instrument producing the music. For example: a woofer is designed to be highly compliant with very low moving mass and a low resonant frequency. Existing known obscure transducers that were never intended to be applied in speakers for this purpose work and have been used experimentally to prove the concept. New transducers may be designed to further extend and prove the concept. For example, current copper-clad aluminum windings of existing transducers could be replaced with copper-clad beryllium windings to significantly reduce the mass of a transducer.

According to additional embodiments of the invention, a very low mass mid-range and high frequency type transducer is specifically dedicated to reproducing efficiently the overtone spectra contained in music. This is not to be confused with the common mid-range transducer produced today. This new device and method will likely be placed and positioned closely to the larger bass transducer (a woofer) and would accurately reproduce the musical overtones. One possible starting point for this new device is to have an efficient frequency range from approximately 100 Hz-2000 Hz and for this device to be attenuated approximately −10 dB. Most overtones in music are −10 dB below fundamental tone so a dovetailing type match can be made and improved sound would result.

According to additional embodiments of the invention, one or more array(s) of very small transducers with minimal moving mass with or without separate amplification work in tandem grouped closely together to reproduce the lowest audible frequencies while keeping all related overtones completely intact. In one embodiment a long column of small transducers quickly switches and/or cycles on and off with precision—even switching at speeds faster than that of the speed of sound consecutively so low frequencies can be continually reinforced over the length of the column and quickly be acoustically multiplied. High sound pressure levels and intensity are realized from the length of the column (low frequency wavelengths are long) and the overtones are left un-attenuated and intact.

This effect could be compared to frames-per-second in movies and videos. The moving frames provide the viewer with a flowing and precise image. The high speed switching of many multiple transducers will produce an acoustic effect comparable to that of many frames-per-second of video. An example illustrates the concept: lighting and its audible result called thunder in nature could be thought of as a very long column (a line source) of sound. Potential energy is high, the mass is low, and its speed of propagation is fast. The resultant acoustic event literally shakes windows and houses with great intensity. A scaled-down high-speed, low mass switching acoustical device roughly simulates the way thunder propagates from top to bottom through our atmosphere in nature. This type of device would have potential for very low frequencies to be realized using small transducers with great potential resulting intensity while keeping overtones and resultant waveforms intact. An alternative construction includes a circular array containing multiple transducers operating in the same fashion, as well as any other desired geometric array of multiple transducers.

According to additional embodiments of the invention, multiple transducers are used to accurately reproduce the entire musical and audible spectrum in loudspeaker design. The crossover frequency (the transition from a low frequency transducer to a smaller and lower mass high frequency transducer) is implemented in a fashion that keeps the overtones accurately intact and that smoothly and uniformly transitions from a low frequency transducer to a high frequency transducer with commonly accepted low and high pass filtering techniques.

"Musical instruments and the human voice produce fundamental frequencies and overtones of fundamental frequencies. The overtone structure is one of the characteristics which distinguishes various instruments and voices. If musical instruments produced the fundamental without overtones, each instrument would produce a pure sine wave and would, therefore, be the same as the output of all other instruments except for the possibility of a difference in frequency and intensity."—Harry F. Olson When an instrument produces a single note or tone the fundamental tone is perceived. A set of second, third, fourth, fifth, etc. harmonic overtones at different intensities and phases are also generated and perceived. As an example of this: when the largest and longest open string on the contrabass is plucked a fundamental resonant of tone 41 Hz (low E on the musical scale) is heard and observed; many relating sounds called overtones and harmonics covering nearly the entire audible acoustic spectrum are simultaneously heard and observed. These overtones are directly related to the fundamental frequency (41 Hz) and are often (but not always) lower in intensity than the fundamental. When the fundamental and overtone spectra are combined, the resultant wave is observed. A reference and explanation can be studied in the book called Music, Physics and Engineering on pages 207-212 written by Harry F. Olson—an often and common referenced engineering manual of music.

Observing the entire acoustic spectrum and/or the resultant wave of the fundamental when combined with the overtones allows the human ear to distinguish one instrument, voice, or note from another. Frequency, energy, time, resonance, timbre, and tone are some of the key elements here.

To the trained listener, the differences between a real and live event when compared to the identical live event amplified or recorded and reproduced through a loudspeaker system can be easily discerned. There are typically stark and contrasting audible differences between the two events. Much of the problem with loudspeakers not sounding as true to the live musical or speech event is in the area of accurately reproducing the overtones in relation to the fundamental through the loudspeaker. This failure is due to an overlooked and improper relationship match to mass of the musical device and the moving mass of the loudspeaker attempting to reproduce the sound of the musical device. A skewed waveform (the combined fundamental and overtone) results when the moving mass of the transducer is heavier than that of the moving mass of the musical instrument producing the original musical event.

To help illustrate the concepts discussed herein, FIG. 1 illustrates a representative speaker 10. The speaker 10 may include a housing containing several differently-sized transducers for transducing electrical signals into audible signals. For example, a typical speaker may include one or more high-range transducers or tweeters, one or more midrange transducers, and one or more low-range transducers or woofers. Another speaker may only have a woofer and a tweeter. Where multiple of any of the tweeters, mid-range transducers, or woofers are present, such transducers may or may not be similarly sized and configured. Thus, a speaker might have one, two, three, four, five, six, or more transducers, and those transducers may all be differently sized to produce different frequency ranges. Similarly, a speaker may have multiple transducers that are substantially identical. Each speaker having multiple transducers of different sizes often includes crossover devices or circuitry configured to cause differently sized transducers to produce different ranges of frequencies.

By way of example, the illustrative speaker 10 of FIG. 1 includes a single tweeter 12, two substantially similar midrange transducers 14, and a single woofer 16. Any of a variety of other configurations could be illustrated, and the speaker 10 of FIG. 1 is thus intended only to be illustrative and form a background for the remainder of the discussion herein. While not illustrated in FIG. 1, some speakers or speaker systems further include a subwoofer as an extremely low-range transducer for reproducing very low-range frequencies. Commonly, but not necessarily always, a subwoofer is separately powered and is contained in its own enclosure.

Commonly used loudspeaker transducers (e.g. transducers used for tweeter 12, midrange transducer 14, and woofer 16) typically have on average twice to ten times (and often even more) the moving mass of the vibrating component of most vibrating and resonating musical instruments and devices producing the original musical event. By way of examples of vibrating components of musical instruments, such vibrating components include strings (for string instruments such as violins, cellos, harps, and the like), membranes (for many percussion instruments such as drums), and air masses (for wind and brass instruments such as oboes, saxophones, trumpets and tubas). As a specific example, the vibrating and resonating moving mass of the open E string (41 Hz) on an electric bass might have a string mass of 20.9 grams (a length of 34.5") and produce a 41 Hz fundamental tone with all its related overtones. When played, the string produces a specific resultant wave with certain overtones.

When that resultant audio wave is recorded and then fed through a loudspeaker with just twice the moving mass of the original string mass, attenuation of the fundamental frequency and of the overtones is observed. The highest frequencies are skewed the most prominently and a dramatic low pass filtering effect occurs (the highest frequencies are attenuated more and more going up in frequency). Additionally, a slower acceleration and a slower braking effect of the transducer is observed due to its heavier mass. The result is a skewed and inaccurate produced waveform and the reproduced event does not sound like the original musical event. Describing this negative attribute is simple: the music is not as lively or energetic sounding. The sound is mellowed out, often described as "warmer" and dampened. Efficiency and intelligibility is also lowered and degraded.

When a loudspeaker reproducing the original event (musical sounds) has just twice the moving mass when compared to the musical element creating the recorded event it is replicating, the fundamental and overtones must be compromised and an inaccurate resultant wave is then observed. As mentioned above, however, many transducers have moving masses not just twice the moving mass of the element creating the original event, but as much as ten times the moving mass of the original device creating the recorded sound event. If the mass of the transducer is heavier than the mass of the musical device (or moving element thereof) an unwanted and skewed result occurs, and the result worsens as the transducer mass increases. The most prominent result is an attenuation of the fundamental and the progressive attenuation (low pass filtering) of the harmonics.

A loudspeaker (even those most highly regarded for their accuracy and quality) can have a very linear and extended frequency response range yet reproduce overtones and resultant wave shapes very poorly and inaccurately. Common subwoofers reproduce audible frequencies from 20 Hz-200 Hz. Most subwoofers on average have a moving mass of 100-200 grams. Nevertheless, subwoofers are typically called on to reproduce sounds from musical instruments with moving components much smaller in mass than this. The result is slow, very inaccurate, and inefficient sound reproduction. Similar problems are encountered with common woofers, common mid-range transducers, and common tweeters.

Embodiments of the invention provide a new and proprietary method for improving this discrepancy and dichotomy in the science and art of loudspeaker design. The method dramatically improves upon the prior art in new and exciting ways. This can be achieved in a number of ways.

First, through the use of material science, new and improved transducers (a woofer for example) are specifically designed to match or at least more-closely match the mass of the moving component (e.g. string, membrane, air mass, etc.) of the musical instrument producing the music or sound. Very few transducers that might qualify for this duty application even exist today, and none are currently used or adopted for use in speakers. As an example, a woofer is used that is highly compliant with very low moving mass and a low resonant frequency. Experiments to date have proved the concept. Further work will bring this concept to fruition. Returning to the example of FIG. 1, new low-mass transducers may be used in place of existing high-mass transducers for any or all of the woofer 16, the midrange transducers 14 and the tweeter 12. In other speaker examples, low-mass transducers may be used for one or more subwoofers, woofers, midrange transducers, and tweeters of any varying sizes.

Thus, according to embodiments of the invention, a transducer for use in a speaker has a moving element, and the moving element is limited in mass to approximately the mass of a moving and sound-generating portion of a recorded sound-producing device having a fundamental frequency within the range of frequencies the transducer is intended to reproduce. In the remainder of the detailed description, such a transducer may be referred to as a "mass-limited transducer." In certain embodiments, the mass of the moving element of the mass-limited transducer is less than twice the mass of the moving and sound-generating portion of the recorded sound-producing device. In other embodiments, the mass of the moving element of the mass-limited transducer is less than a percentage of between 100% to 200% of the mass of the moving and sound-generating portion of the recorded sound-producing device. By way of non-limiting examples, the comparative percentage mass limit of the moving element of the mass-limited transducer compared to the moving and sound-generating portion of the sound-producing device may be any single percentage between 100% and 200%, e.g. 100%, 101%, 102%, 103%, 104%, 105%, 106%, 107%, 108%, 109%, 110%, 111%, 112%, and so on, 120%, 121%, 122%, and so on, 130%, 131%, 132%, and so on, 140%, 141%, 142%, and so on, 150%, 151%, 152%, and so on, 160%, 161%, 162%, and so on, 170%, 171%, 172%, and so on, 180%, 181%, 182%, and so on, 190%, 191%, 192%, and so on through 198%, 199%, and 200%.

It should be noted that in a speaker having a plurality of transducers of different sizes, such as a speaker of the type illustrated in FIG. 1, smaller transducers intended to reproduce higher frequencies, such as the tweeter 12, generally have smaller moving masses than larger transducers. Indeed, smaller transducers may have a moving component having a mass that approximates the mass of moving and sound-generating portion of a recorded sound-producing device having a low fundamental frequency. However, in existing speakers with existing transducers, such low fundamental frequencies are significantly lower than a range of frequencies that each particular transducer is intended to reproduce, and such small transducers would not be included in the definition of mass-limited transducers. For example, in a particular speaker, the speaker may be configured using crossovers such that the tweeter largely produces frequencies only over approximately 2000 Hz (2 kHz). Thus, even though the tweeter might have a relatively low moving mass (at least compared to a similarly designed woofer or midrange transducer incorporated in the speaker), it would not be a mass-limited transducer as it is used in the speaker, because it is not incorporated in the speaker in a manner to produce low frequencies. Thus, the transducer is not a mass-limited transducer in instances where it is not used to produce frequencies that are low enough such that the moving mass of the transducer is limited in mass to approximately the mass of a moving and sound-generating portion of a recorded sound-producing device at a fundamental frequency range of the recorded sound-producing device intended to be reproduced by the transducer.

In certain embodiments of the invention, a speaker having a plurality of transducers includes one mass-limited transducer. In other embodiments of the invention, a speaker having a plurality of transducers includes two mass-limited transducers. In other embodiments of the invention, a speaker having a plurality of transducers includes three or more mass-limited transducers. In each of the foregoing examples, the speaker may optionally have one or more transducers that are not mass-limited transducers. Thus, according to embodiments of the invention, a speaker having any given number of transducers N (by way of example and not necessarily limitation, the number N may be any number where N is greater than or equal to 1 and less than or equal to 100 ($1 \leq N \leq 100$)) where at least one and up to all of such transducers are mass-limited transducers. Thus, if a number M of the N transducers are mass-limited transducers, in embodiments of the invention, the number M may be any number where M is greater than or equal to 1 and less than or equal to N ($1 \leq M \leq N$). Therefore, according to embodiments of the invention, a speaker incorporates features of the invention where it has any number of transducers N, where a selected number M of those transducers are mass-limited transducers, and where $1 \leq M \leq N$.

Figure 2:
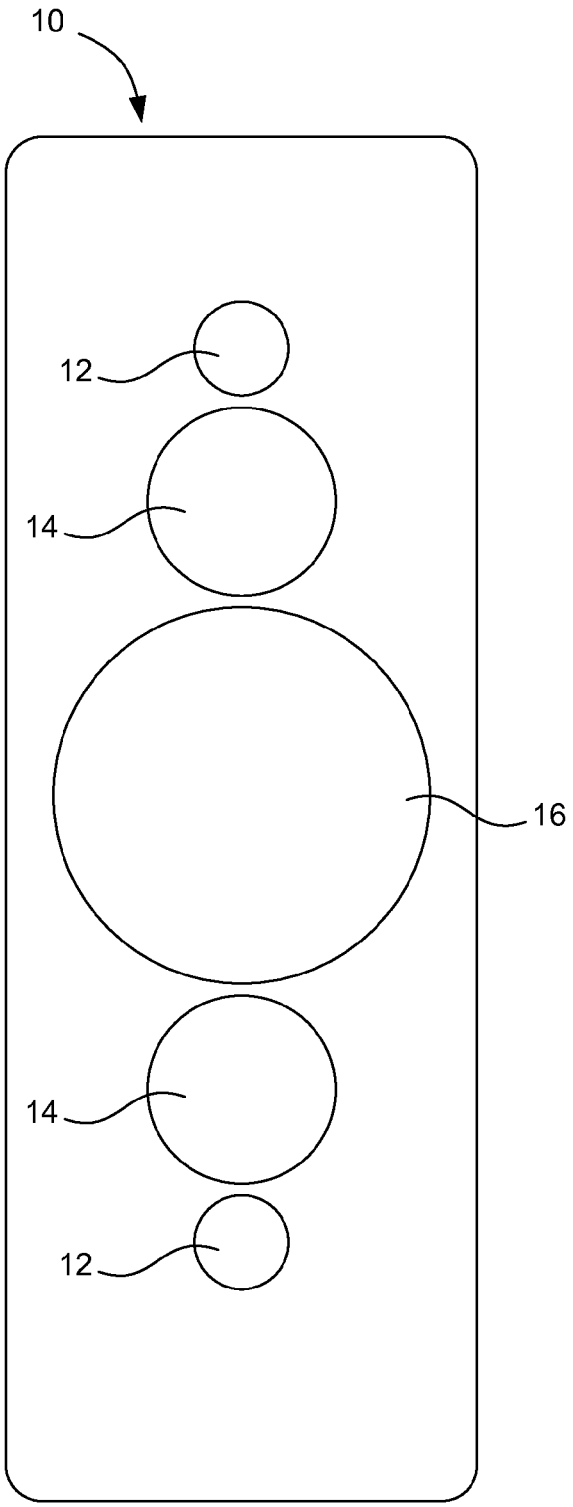
FIG. 2 shows a representative speaker.
Figure 3:
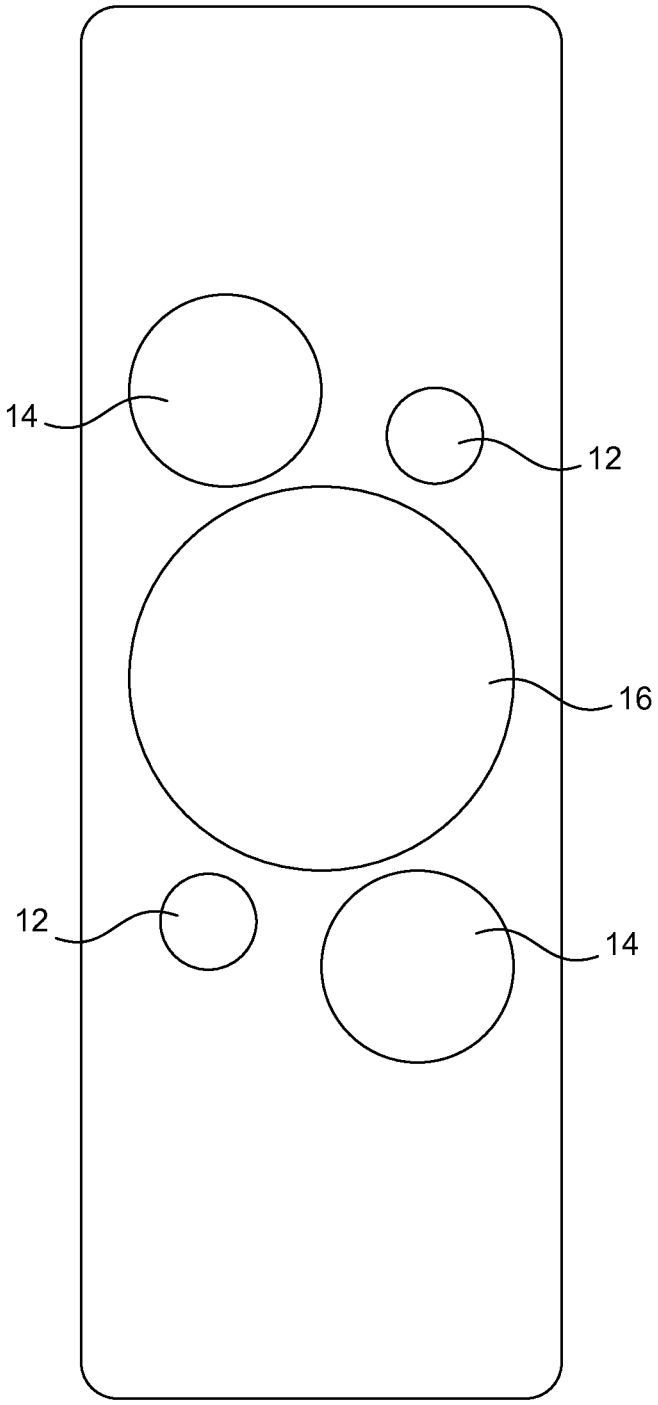
FIG. 3 shows a representative speaker.

According to embodiments of the invention, a very low-mass mid-range and high frequency type transducer is specifically dedicated to reproducing efficiently the overtone spectra contained in music. This is not to be confused with the common mid-range transducer produced today. This new device and method will act as an adjunct to the larger transducer and would likely be placed and positioned closely to the larger bass transducer (e.g. a woofer) and would accurately reproduce the musical overtones, as is illustrated in FIG. 2. In this illustrative embodiment, the speaker 10 includes the woofer 16, which is a mass-limited transducer in this embodiment. Furthermore, two low-mass midrange transducers 14 are placed in very close proximity to the woofer 14, and low-mass tweeters 12 are further placed in close proximity to the midrange transducers 14. In an alternate configuration, the tweeters 12 are also placed in close proximity to the woofer 14, as in FIG. 3. In a representative example, a low-mass midrange transducer to be positioned proximate a woofer may have an efficient frequency range from approximately 100 Hz to 2000 Hz and for may be attenuated approximately −10 dB compared to the woofer. In many instances, overtones in music are approximately −10 dB below fundamental tone so a dovetailing type match of this type can be made and improved sound would result.

According to additional embodiments of the invention, array(s) of very small transducers with minimal moving mass with or without separate amplification work in tandem grouped closely together to reproduce the lowest audible frequencies while keeping all related overtones completely intact. As one example illustrated in FIG. 4, a plurality of small transducers 20 are arranged in a long column of small transducers that quickly switch and/or cycle on and off with precision. Processing to control the switching or cycling may occur using a variety of processes (for example, in the digital domain or via analog processes). They may even be switched at speeds faster than that of the speed of sound consecutively so low frequencies can be continually reinforced over the length of the column (or other array) and quickly be acoustically multiplied. High sound pressure levels and intensity are realized from the length of the column (low frequency wavelengths are long) and the overtones are left un-attenuated and intact.

This effect could be compared to frames-per-second in movies and videos. The moving frames provide us with a flowing and precise image. The high speed switching of many multiple transducers will produce an acoustic effect comparable to that of many frames-per-second of video. An example: Lighting and its audible result called thunder in nature could be thought of as a very long column (a line source) of sound. Potential energy is high, the mass is low, and its speed of propagation is fast. The resultant acoustic event literally shakes windows and houses with great intensity. Embodiments of the invention utilize the same principle in a scaled-down high-speed, low-mass switching acoustical device that roughly simulates the way thunder propagates from top to bottom through our atmosphere in nature. This type of device would have potential for very low frequencies to be realized with great potential intensity while keeping overtones and resultant waveforms intact.

Figure 4:
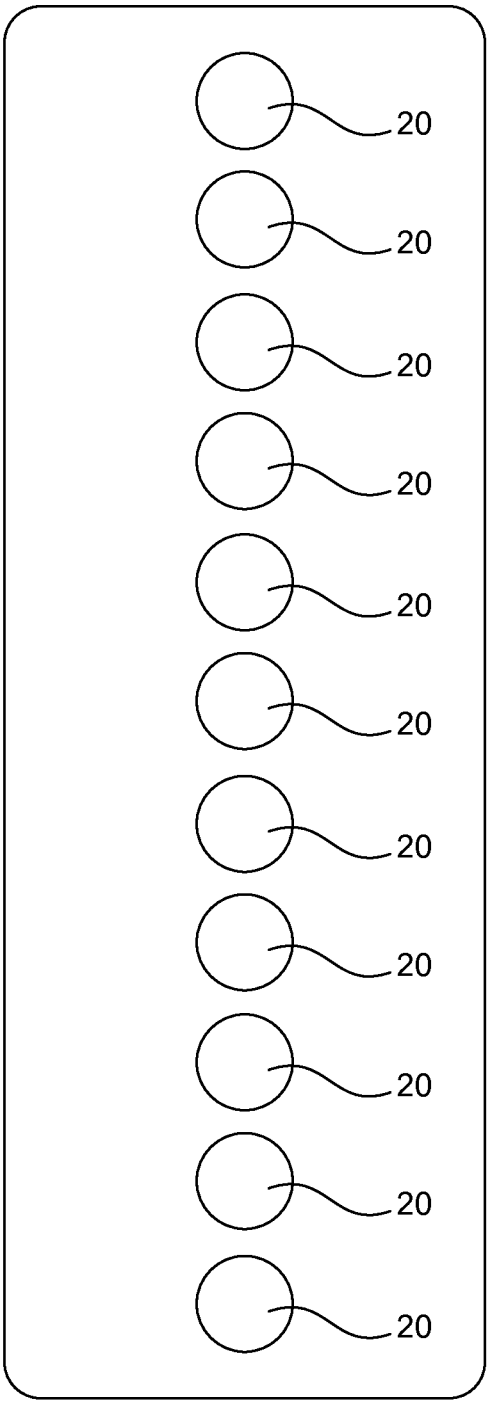
FIG. 4 shows a representative speaker.
Figure 5:
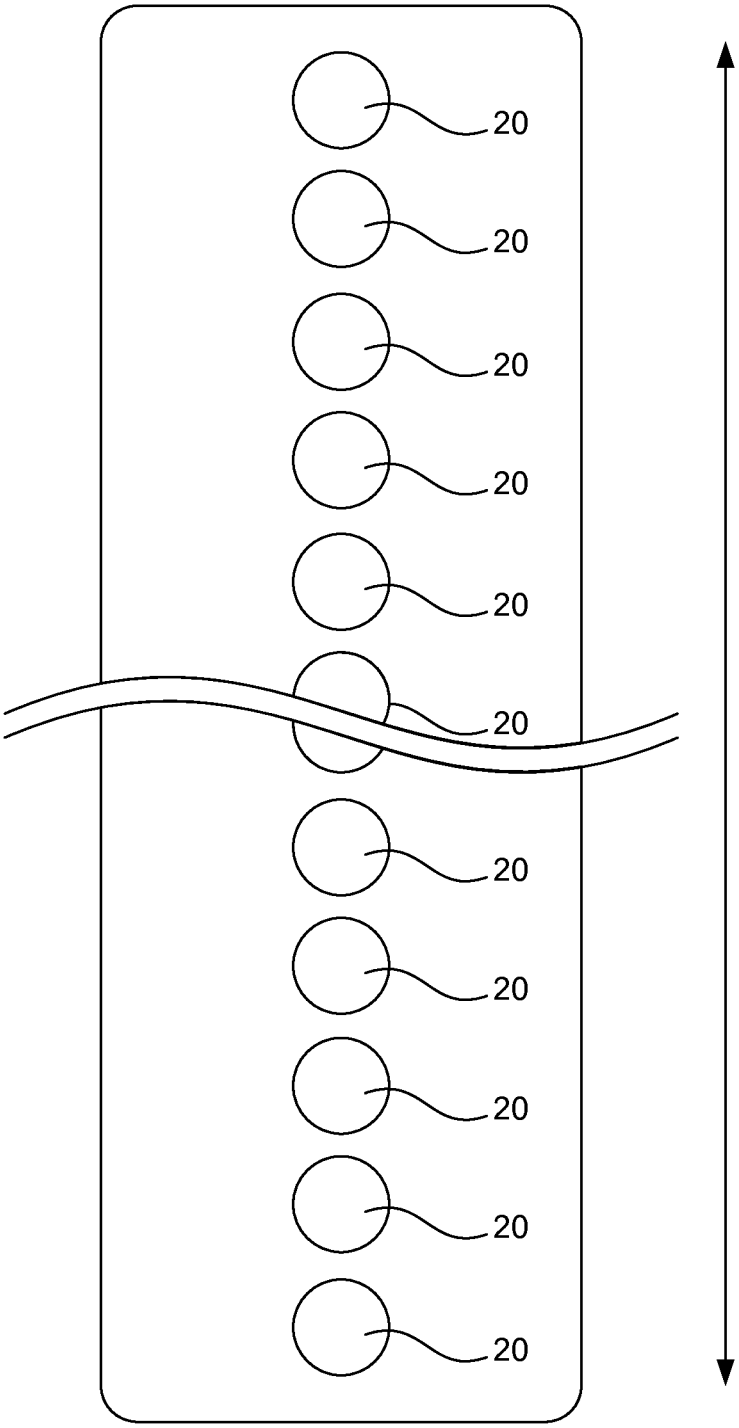
FIG. 5 shows a representative speaker.

While FIG. 4 is intended to illustrate the principle discussed above, it should be understood that the principle may be extended to essentially any desired dimension. Thus, while FIG. 4 shows a linear array of eleven small transducers 20, such an array may be of any practical or desired length, such as is illustrated in FIG. 5. For example, a speaker intended for use in a home may have a linear array of small transducers 20 that is significantly shorter and has fewer small transducers than a speaker (or speaker system) intended for use in an arena with a large concert. In such a use, a much larger linear array of small transducers 20 may be used. Thus, FIG. 5 is intended to show that the linear array concept may be extended to any size as desired, and may even be extended across multiple speakers or enclosures containing a portion of the linear array of small transducers 20.

Figure 6:
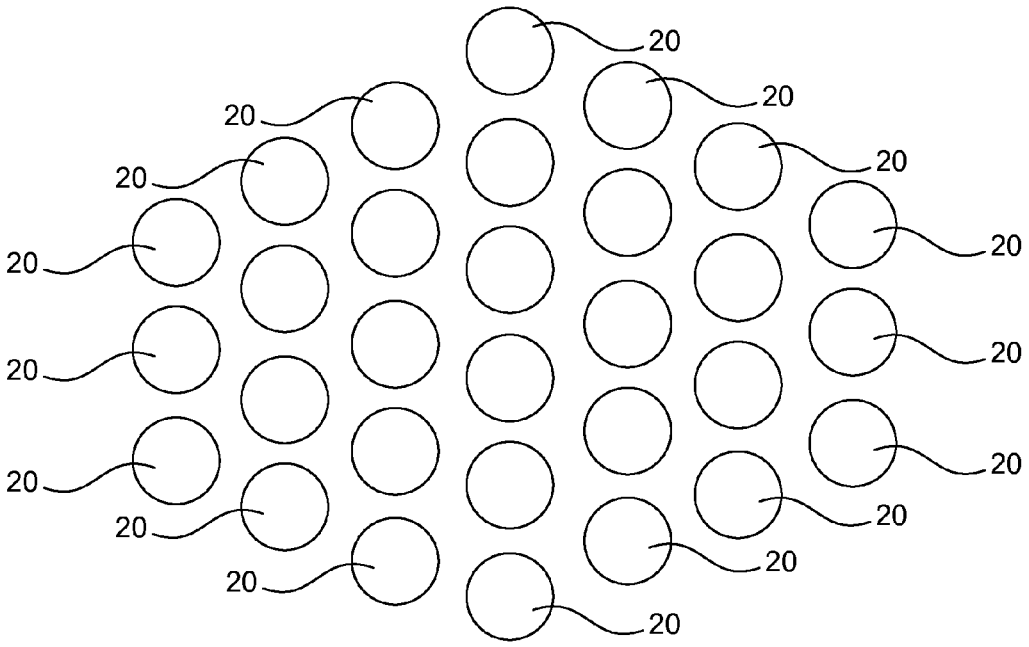
FIG. 6 shows a representative transducer array for use in a speaker.
Figure 7:
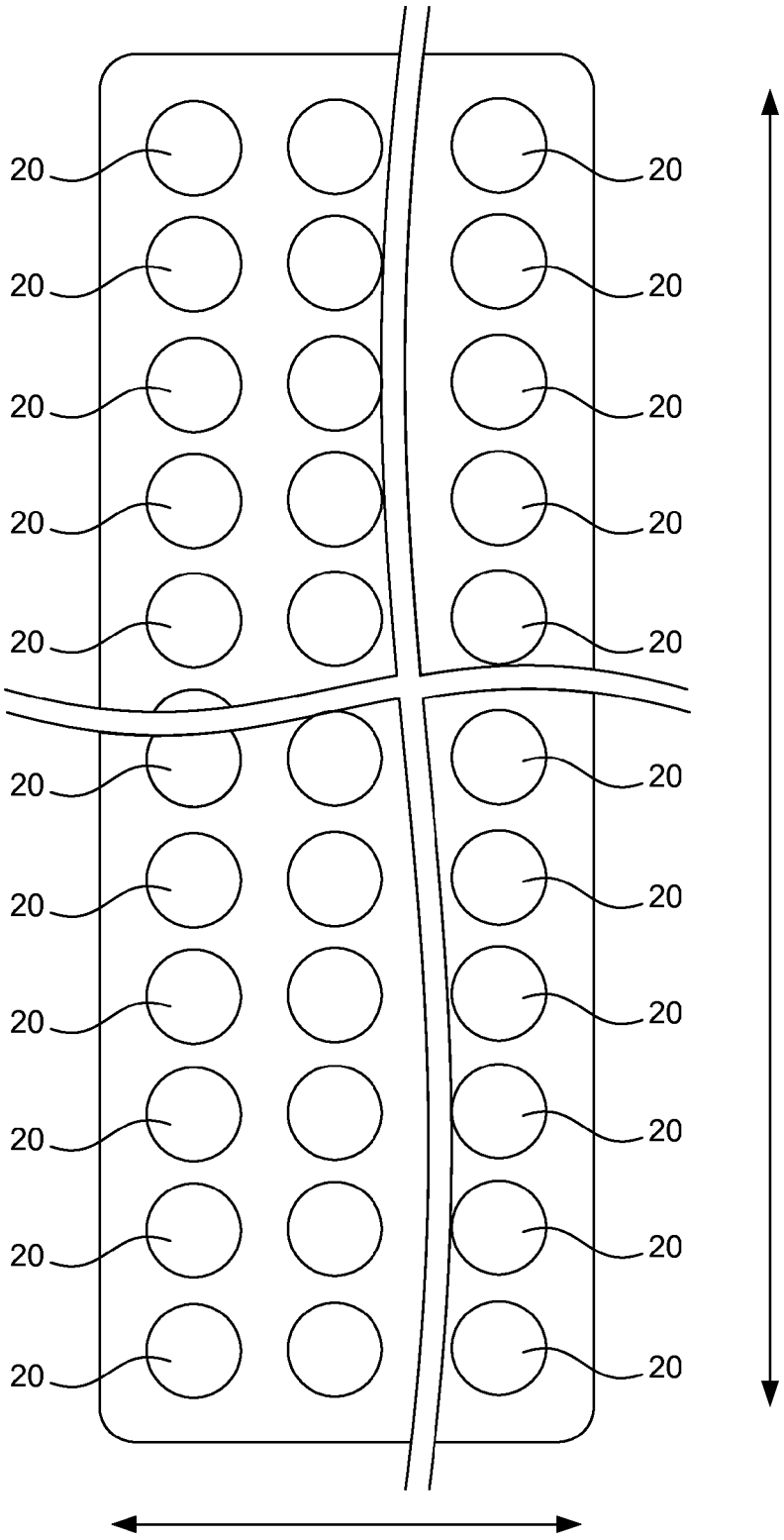
FIG. 7 shows a representative speaker.

Other arrays of small transducers 20 may be provided to operate on similar purposes, such as an array of small transducers 20 in the form of a circular disc, as well as any other desired geometric array of multiple transducers. By way of example, FIG. 6 illustrates a non-linear array of small transducers 20 that may be incorporated into a speaker. By way of another example, FIG. 7 illustrates a speaker containing a planar array of small transducers 20. In a fashion similar to that of FIG. 5, FIG. 7 shows that the concepts of a planar array of small transducers 20 can be extended in multiple directions along a plane (which may include a flat plane or a curved plane, as desired) to whatever extent desired. For example, essentially an entire wall may be covered by an array of small transducers 20, as is illustrated by FIG. 7.

It is also anticipated for multiple transducers to be used to accurately reproduce the entire musical and audible spectrum in loudspeaker design. According to embodiments of the invention, the crossover frequency (the frequency of transition from a low frequency transducer to a smaller and lower-mass high frequency transducer) of a speaker may be implemented in a fashion that keeps the overtones accurately intact. Additionally, the crossover frequency may be implemented to simply transition from a low-frequency transducer to a high-frequency transducer with commonly accepted low and high pass filtering techniques.

Figure 8:
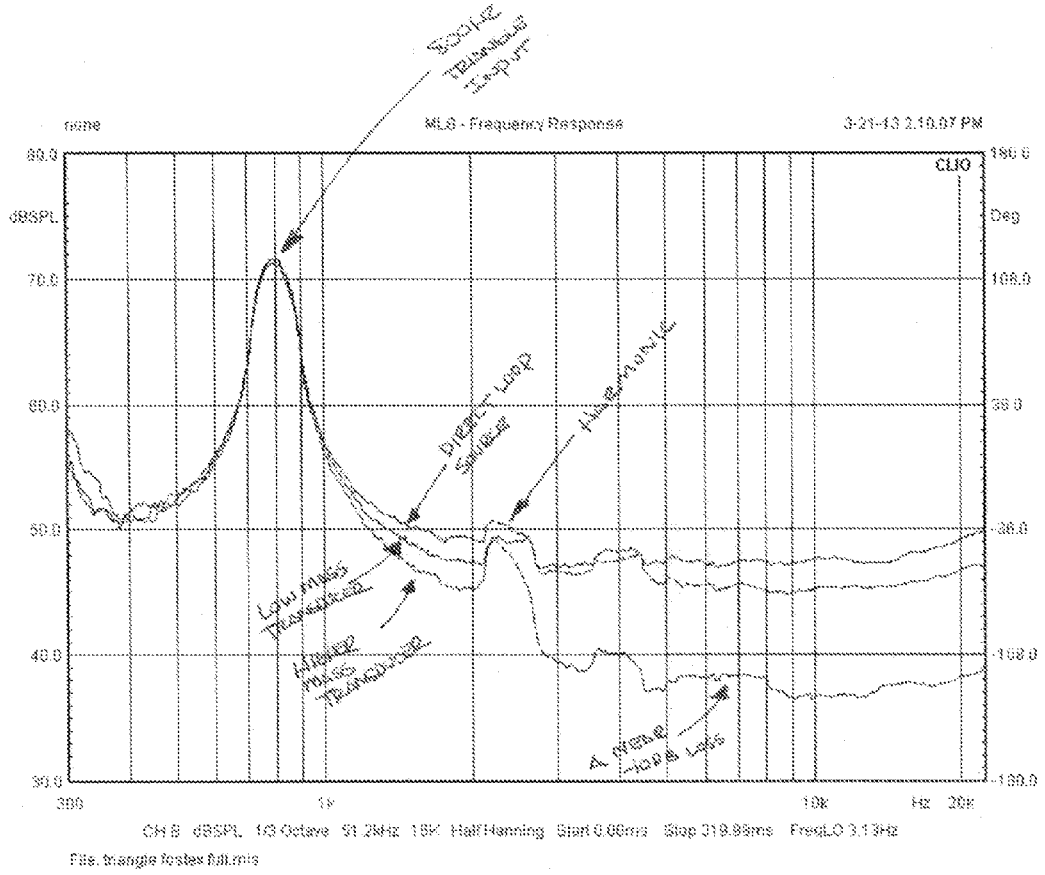
FIG. 8 shows a frequency response graph.

FIG. 8 illustrates the benefits of embodiments of the invention. FIG. 8 shows a frequency response chart of an input signal superimposed on frequency response charts of a relatively high-mass transducer and a relatively low-mass transducer. Both transducers used for the frequency response charts are efficient transducers and have linear frequency responses extending to 18 kHz. The input signal is an 800 kHz triangle input, with the fundamental frequency represented by the largest peak. As can be seen from the respective graphs, the relatively low-mass transducer achieves a frequency response that is significantly closer to the original source signal. In contrast, the relatively high-mass transducer is unable to reproduce the original source signal, with a strong low-pass filtering effect being visible, resulting in nearly 10 dB attenuation in the upper frequency ranges. Thus, FIG. 8 illustrates the high-mass transducer's inability to reproduce higher frequencies and the resultant loss to the ear of perceived overtones.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. A speaker comprising: a transducer configured to reproduce a sound generated by a moving and sound-generating portion of a musical instrument, the transducer comprising a moving element, wherein the moving element is limited in mass to approximate the mass of the moving and sound-generating portion of the musical instrument.

2. A speaker as recited in claim 1, wherein the mass of the moving element comprises a mass of less than twice the mass of the moving and sound-generating portion of the musical instrument.

3. A speaker as recited in claim 1, wherein the mass of the moving element comprises a mass of less than 150% the mass of the moving and sound-generating portion of the musical instrument.

4. A speaker as recited in claim 1 comprising:

a plurality of transducers as recited in claim 1.

5. A speaker as recited in claim 4, wherein the plurality of transducers comprises transducers of different sizes configured to reproduce different frequency ranges of sound.

6. A speaker as recited in claim 1, wherein the speaker comprises a plurality of transducers as recited in claim 1, the plurality of transducers being arranged in an array of transducers.

7. A speaker as recited in claim 6, wherein the array of transducers is linear.

8. A speaker as recited in claim 6, wherein the array of transducers is circular.

9. A speaker as recited in claim 6, wherein the array of transducers is planar.

10. A speaker as recited in claim 1, wherein the speaker also comprises one or more transducers that is not mass limited.

11. A transducer for use in a loudspeaker, the transducer being intended for use in reproducing sound frequencies over a selected frequency range, the transducer comprising: a moving element, wherein the moving element is limited in mass to approximate the mass of a moving and sound-generating portion of a musical instrument having a fundamental frequency within the selected frequency range.

12. A speaker comprising a transducer as recited in claim 11, wherein the mass of the moving element comprises a mass of less than twice the mass of the moving and sound-generating portion of the recorded sound-producing device.

13. A speaker comprising a transducer as recited in claim 11, wherein the mass of the moving element comprises a mass of less than 150% the mass of the moving and sound-generating portion of the musical instrument.

14. A speaker comprising a plurality of transducers as recited in claim 11, wherein the plurality of transducers are arranged in an array of transducers.

15. A speaker as recited in claim 14, wherein the array is an array selected from the group consisting of:

a linear array;

a circular array;

a flat planar array; and a curved planar array.

16. A speaker comprising: an array of transducers, each of the transducers comprising a moving element, wherein the moving element of each transducer is limited in mass to approximate the mass of a moving and sound-generating portion of a musical instrument that each transducer is intended and adapted to reproduce.

17. A speaker as recited in claim 16, wherein the array is linear.

18. A speaker as recited in claim 16, wherein the array is circular.

19. A speaker as recited in claim 16, wherein the array is planar.

* * * * *